United States Patent [19]

Fang

[11] Patent Number: 4,725,760

[45] Date of Patent: Feb. 16, 1988

[54] STRUCTURE OF FLASHER BULB

[76] Inventor: Cheng Ping Fang, 15, Alley 5, Lane 148, Hsiu Lang Rd., Sec. 2, Yung Ho, Taiwan

[21] Appl. No.: 817,080

[22] Filed: Jan. 8, 1986

[51] Int. Cl.[4] ..... H01J 19/78; H01J 7/44

[52] U.S. Cl. ..... 315/73; 445/27; 315/185 S; 315/72; 315/74; 315/122; 315/125

[58] Field of Search ..... 315/185 R, 185 S, 200 A, 315/73, 72, 122; 445/23, 27, 28

[56] References Cited

U.S. PATENT DOCUMENTS

| | | | |
|---|---|---|---|
| 2,235,360 | 3/1941 | Davis | 315/73 |
| 2,318,700 | 5/1943 | McCabe | 315/73 |
| 2,760,120 | 8/1956 | Fisherman | 315/186 |

*Primary Examiner*—Leo H. Boudreau

*Assistant Examiner*—Mark R. Powell

*Attorney, Agent, or Firm*—Holman & Stern

[57] ABSTRACT

A flasher bulb and method of making same by mass production techniques are disclosed. The flasher bulb has first and second nickel wires connected by a tungsten wire to form a loop and a bimetallic strip one end of which is connected to one of the nickel wires, the strip being bent towards the other nickel wire. When the strip is heated by passage of current through the tungsten wire, it makes contact with the other nickel wire to take the tungsten wire out of circuit but retain current flow through the nickel wires. Accordingly in a string of flasher bulbs, extinction of one bulb will not necessary cut off current to the others. The conductive wires and bimetallic strip are assembled in position in a mold and held in place by an insulating disk.

2 Claims, 8 Drawing Figures

STRUCTURE OF FLASHER BULB

FIELD OF THE INVENTION

This invention relates to a flasher bulb for use with a light string to provide flashing intermittently without cutting off electrical power to other lights in the light string. The invention also relates to a method of making a flasher bulb as aforesaid.

BACKGROUND OF THE INVENTION

Flasher bulb for use in ornamental light strings are well known. One known form of flasher bulb, for example, is shown in FIG. 1. This bulb includes an insulating body A which fixes respective nickel wires N1 N2 in position inside a glass shell D. Between the two nickel wires is bimetallic element B, and a tungsten wire C is connected at one end to nickel wire N1 and at its other end to the top of the bimetallic element B thus forming a loop, while the top of the second nickel wire N2 is in contact with the bimetallic element.

When current is passed through the bulb, the bimetallic element B is in a "on" state and all of the bulbs in the string will switch on. After the current has been transmitted for a certain period of time, the bimetallic piece B will deform and separate from the second nickel wire thereby interrupting the current in all the bulbs in the string which are thereby extinguished. Thereafter, the bimetallic element cools and resorts to is original contact condition thereby allowing current to flow and relight all the bulbs. Repeated heating and cooling of the bimetallic strip thereby effects continuous flashing of all the bulbs in a string. Thus, all of the bulbs are lighted and extinguished simultaneously.

A further known form of a flasher bulb, is shown in FIG. 2. In this arrangement, nickel wires N1′ and N2′ are fixed in position on an insulating element A′ inside a glass shell D′ and a bimetallic element B′ is bent in the shape of an arc and connected with tungsten wire C′ at the top while the outside of the bimetallic element is connected by spot welding to the second nickel wire N2 and the tungsten wire is itself connected to the first nickel wire N1′. When current is caused to flow through the bulb, the tungsten wire will brighten and produce heat, and the bimetallic element thus heated will bend causing its lower end to move towards the first nickel wire N1′. When the bimetallic element contacts the first nickel wire current flow to the tungsten wire will be obstructed and the bulb will be extinguished. However, current will still flow to the remaining bulbs in a string through the nickel wires and bimetallic element. Thus all the bulbs in a string will not necessarily be lit and extinguished simultaneously and an improved glittering effect may result.

While the flasher bulbs shown in FIG. 2 may improve the glittering effect compared with the bulb shown in FIG. 1, certain defects may still exist. Thus, both the bimetallic element B′ and the second nickel wire N2′ are somewhat delicate and need to be carefully and skillfully spot welded together. This process is such that the bulbs can not readily be mass produced by automatic machinery. Moreover, it is difficult to control the welding process to provide the requisite clearance between the bimetallic element and the nickel wire N1′. The accuracy of the flashing period of the bulb may thus be effected and become irregular.

SUMMARY OF THE INVENTION

It is a principle object of the present invention to provide an improved flasher bulb structure whereby a current interruption to one flasher bulb of a string still allows current to flow to the remaining bulbs. An essential element of the invention resides in the provision of a bimetallic member which is fixed in position in a novel way in an insulating body and cooperates with respective nickel and tungsten wires which are also set in the insulating body in a novel manner.

The invention also comtemplates a novel apparatus for making the flasher bulb using a mold with various apertures which are set for accurately controlling the clearance between the bimetallic element and the nickel wire when such elements are combined in the mold.

DESCRIPTION OF PREFERRED EMBODIMENT

Figure 1:
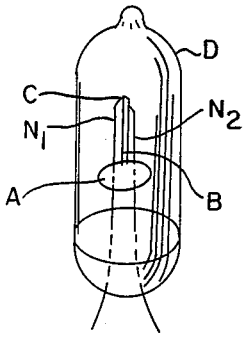
FIG. 1 PRIOR ART
FIGS. 1 and 2 are perspective views of known forms of flasher bulbs.
Figure 2:
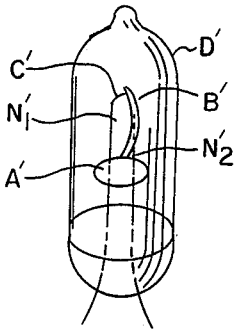
FIG. 2 PRIOR ART
Figure 8:
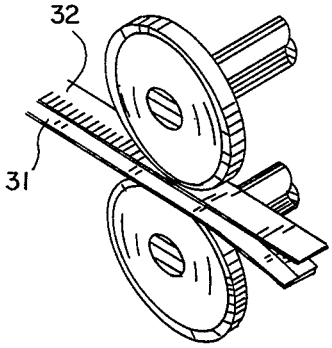
FIG. 8 is a perspective view showing rollers used for welding respective pieces of the bimetallic strip.

A flasher bulb in accordance with the invention comprises a glass shell 11, a first nickel wire 1 extending into the shell from the base, a second similar nickel wire 2, spaced from wire 1 and extending into the shell to a somewhat greaer height than wire 1, a bimetallic strip 3 set in position between the wires 1 and 2 and composed of two bimetallic pieces 31 and 32, and a tungsten wire 4 connected between the upper ends of the first and second nickel wires. The bimetallic pieces 31 and 32 have different coefficients of expansion and overlap at the respective ends and the piece 32, which is of lower coefficient expansion is set to contact the first nickel wire while the upper end of piece 31 is bent towards the second nickel wire 2 with a slight clearance therebetween in the cold state. The respective wires and bimetallic piece are set in position by means of an insulating element 5.

Figure 4:
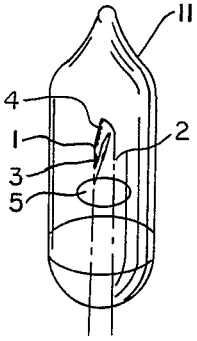
FIG. 4 is a perspective view of the flasher bulb shown in FIG. 3 with a bimetallic strip being shown in a perperative position.
Figure 5:
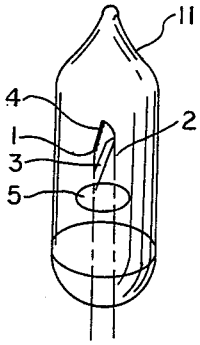
FIG. 5 is a view similar to FIG. 4 showing the position occupied by bimetallic strip after it is heated.
Figure 6:
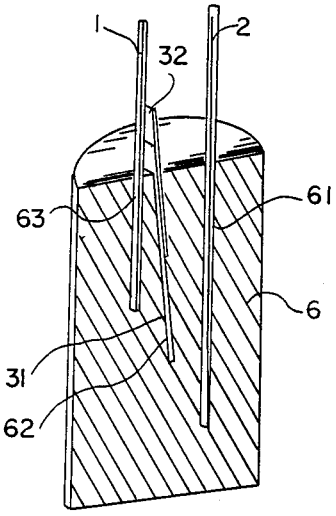
FIG. 6 is a cut away perspective view of a mold showing how the bimetallic strip an conductive wires of the flasher bulb are set in position.

Referring to FIGS. 4 and 5, when current is passed through the nickel wires, the tungsten wire 4 is heated and glows, and heating of the bimetallic strip 3 causes it progressively to bend towards the second nickel wire 2. When the bimetallic piece contacts the second nickel, the tungsten wire is bypassed for current flow and accordingly the bulb is extinguished. However, in a string of such bulbs current would remain flowing to the remaining bulbs through the bimetallic strip connection between wires 1 and 2. When the tungsten wire 4 cools, so does the bimetallic piece and it is gradually restored to its initial state so that current once more flows through the tungsten wire to light the bulb.

The bulb may be constructed using a mold 6 as shown in FIGS. 4 and 5, the mold having respective blind bores 61, 62, and 63 to receive the wires 1 and 2 and the bimetallic strip and set them in the correct positions both as to depth and angle. After positioning of the strip and wires in the mold, the insulating disk 5 may then be set on the wires and strip in the correctly aligned positions. The arrangement also allows for ready, mass production assembly with accurate positioning of the bimetallic strip without the need for welding to the conductive wire.

Figure 7:
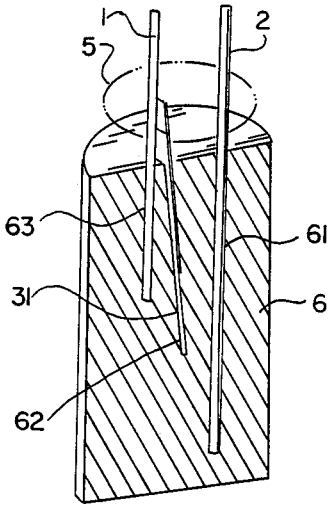
FIG. 7 is a view similar to FIG. 6 showing the positioning of a insulating body on the wires.
Figure 3:
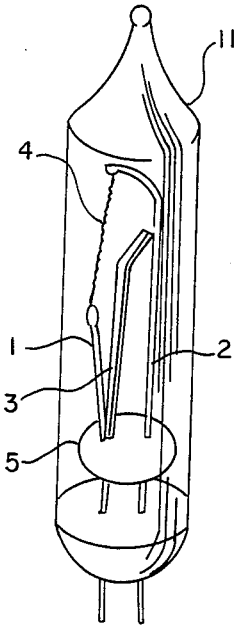
FIG. 3 is an enlarged perspective view of a flasher bulb in accordance with the invention.

FIG. 7 shows a method which may be used for forming the bimentallic strip with automatic wheel welding which joins the respective pieces 31 and 32 in the form of a string from which individual strips may be cross cut. This arrangement also enhances mass production of the bulb.

Because of the construction and method of assembly, the bulb is readily mass produced accurately and in quantity.

I claim:

1. A flasher bulb for use with a light string to provide flashing intermittently without cutting off electrical power to other lights in the light string, comprising:

a glass shell;

a first electrically conductive wire having one end inside said glass shell and another end thereof outside said glass shell;

a second electrically conductive wire having one end inside said glass shell and another end thereof outside said glass shell;

a tungsten wire having a first end and a second end, said first and second ends being respectively connected to ends of said first and second electrically conductive wires which are disposed inside said glass shell;

said first and second electrically conductive wires being electrically connected at respective ends thereof inside said glass shell by said tungsten wire such that current passing between said first and second electrically conductive wires through said tungsten wire causes said tungsten wire to heat and thereby glow;

an insulating body; said first and second electrically conductive wires passing through said insulating body, said insulating body spacing said first and second electrically conductive wires apart a fixed distance at the regions thereof passing through said insulating body;

a bimetalic element which is electrically conductive; said bimetallic element having a fixed end and a free end; said fixed end being in electrical contact with a predetermined portion of said first electrically conductive wire; said fixed end of said bimetallic element and said predetermined portion of said first electrically conductive wire being disposed within said insulating body, such that said insulating body maintains said fixed end and said predetermined portion in electrical contact with one another; said bimetallic element having a first position when relatively cool and a second position when heated above a predetermined temperature;

said bimetallic element being oriented such that heating of said bimetallic element to said predetermined temperature causes bending of said bimetallic element to a position wherein said free end of said bimetallic element is in electrical contact a portion of said second electrically conducting wire, such that electrical current passes between said first and second electrically conductive wires predominantly through said bimetallic element, thereby permitting cooling of said tungsten wire;

whereby in said second position, said bimetallic element cools so as to return to said first position, thereby causing heating of said tungsten wire; and current passing between said first and second electrically conducting wires is substantially uninterrupted during cycling of said bimetallic element between said first and said second positions.

2. A method of making a flasher bulb for use with a light string, such that power to the light string remains uninterrupted during flashing of the flasher bulb, comprising the steps of:

providing a first and a second electrically conducting wires and a bimetallic element;

providing a mold having a relatively flat surface therein, said relatively flat surface having three grooves formed therein for snugly receiving said first and second electrically conducting wires and said bimetallic element in a predetermined relationship such that said groove for receiving said bimetallic element is disposed at a predetermined angle to said groove for receiving said first electrically conducting wire;

placing said first electrically conducting wire and said bimetallic element in their respective grooves such that one end of said bimetallic element is in electrical contact with a portion of said first electrically conductive wire;

placing said second electrically conducting wire in its respective groove;

said predetermined angle being provided such that, when disposed in their respective grooves, said fixed end of said bimetallic element projects beyond said mold;

fixing an insulating body about said first electrically conducting wire in the region where said first electrically conducting wire is in electrical contact with said fixed end of said bimetallic element so as to fixedly support said fixed end of said bimetallic element against said first electrically conducting wire, said insulating body also being fixed about said second electrically conducting wire to space said second electrically conducting wire from said first electrically conducting wire;

a free end of said bimetallic element being oriented such that heating of said bimetallic element brings said free end into contact with said second electrically conducting wire;

connecting a tungsten element between said first and second electrically conducting wires such that, in a first position of said bimetallic element, current flowing between said first and second electrically conducting wires passes substantially entirely through said tungsten wire, and in a second position of said bimetallic element current flowing between said first and second electrically conducting wires passes substantially entirely through said bimetallic element.

* * * * *